US005506763A

United States Patent [19]

Carley

[11] Patent Number: 5,506,763

[45] Date of Patent: Apr. 9, 1996

[54] INCANDESCENT BULB AND REFLECTOR AND METHOD FOR MAKING

[76] Inventor: Curtis J. Carley, 1502 W. 228th St., Torrance, Calif. 90501

[21] Appl. No.: 432,981

[22] Filed: May 2, 1995

Related U.S. Application Data

[63] Continuation of Ser. No. 77,053, Jun. 15, 1993, abandoned, which is a continuation-in-part of Ser. No. 765,911, Sep. 24, 1991, abandoned.

[51] Int. Cl.[6] ..... F21V 7/00

[52] U.S. Cl. ..... 362/341; 362/350; 313/113; 600/248

[58] Field of Search ..... 128/21, 22, 23; 362/350, 341; 313/113

[56] References Cited

U.S. PATENT DOCUMENTS

| | | | |
|---|---|---|---|
| 2,372,937 | 4/1945 | Dircksen . | |
| 4,147,163 | 4/1979 | Newman et al. . | |
| 4,152,755 | 5/1979 | Trospor et al. | 362/158 |
| 4,527,223 | 7/1985 | Maglica | 362/187 |
| 4,546,761 | 10/1985 | McCullough . | |
| 4,583,528 | 4/1986 | Bauman | 128/11 |
| 4,596,239 | 6/1986 | Bauman | 128/11 |
| 4,694,822 | 9/1987 | Bauman | 128/11 |
| 4,728,849 | 3/1988 | Morris et al. | 313/113 |
| 4,729,367 | 3/1988 | Bauman | 128/11 |
| 4,755,711 | 7/1988 | Fields et al. | 313/111 |
| 4,766,886 | 8/1988 | Juhn | 128/9 |
| 4,967,330 | 10/1990 | Bell et al. . | |
| 5,038,755 | 8/1991 | Burgio et al. | 128/9 |

FOREIGN PATENT DOCUMENTS 9110498 3/1991 European Pat. Off. .

*Primary Examiner*—Donald J. Yusko
*Assistant Examiner*—Lawrence O. Richardson
*Attorney, Agent, or Firm*—Curtis L. Harrington

[57] ABSTRACT

The incandescent bulb and reflector system, and method of making, of the present invention includes a small incandescent lamp which is incorporated into one of several embodiments of a reflector base. In a first embodiment, the reflector base is formed as a single piece, in a second embodiment, the reflector base is formed as a base with a separately formed and overlying reflector, in a third embodiment, the reflector base is formed as a base with a separately formed and overlying reflector having an extended axial length land, and in a fourth embodiment, the reflector base is formed as a base with a separately formed reflector which fits within the base. The method of making involves the automated processing of a length of bar stock material, and the subsequent assembly of the component parts to form a lamp system.

15 Claims, 4 Drawing Sheets

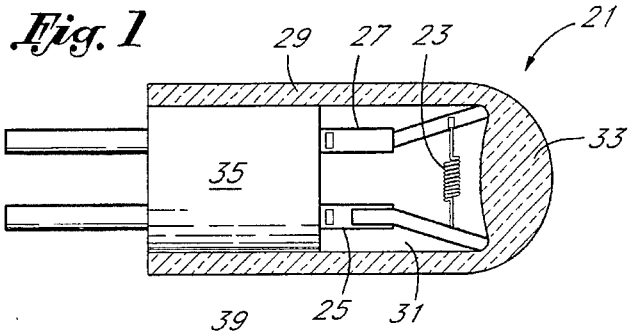
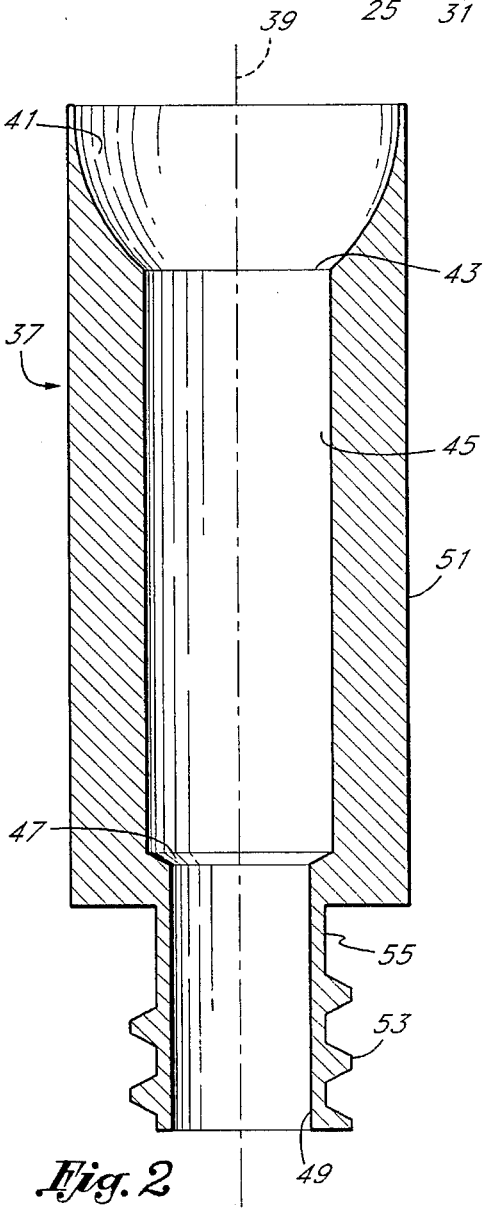
Fig. 2
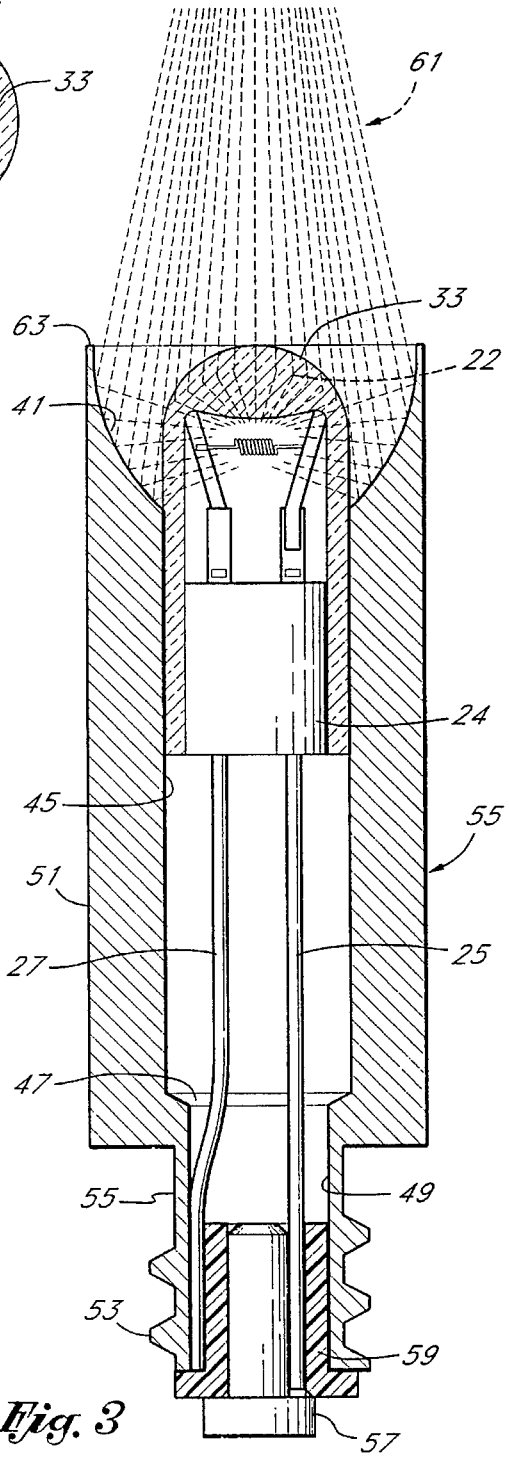
Fig. 3

INCANDESCENT BULB AND REFLECTOR AND METHOD FOR MAKING

This is a continuation of application Ser. No. 08/077,053 which was filed on Jun. 15, 1993 and which was a continuation-in-part of U.S. patent application Ser. No. 07/765,911 filed Sep. 24, 1991. Both of the aforementioned applications are now abandoned.

FIELD OF THE INVENTION

The present invention relates to the field of high intensity, efficient incandescent lamps, reflectors, and a reflector system and method of making an efficient high intensity bulb and reflector system.

BACKGROUND OF THE INVENTION

Incandescent lamps have been well known for several decades and have been employed in a wide variety of circumstances. In more commonplace applications the lamps have been optimized around considerations of fire safety, heat load, size, etc. In the medical field, the design of instruments which use light sources are evolving along with the light sources they employ. Unlike the commonplace applications of incandescent lamps, medical applications require a different set of considerations. For example, in a commonplace application where a higher intensity of light is required, the designer might increase the voltage of the lamp and its glass envelope size. However, in medical applications, increased voltage and current, and even lamp size may not be compatible with the medical instrument with which the light is used.

One method for increasing the light intensity has been the use of fiber optics. In this method, a very high intensity light source is placed in optical alignment with one end of a fiber optic cable. The cable is then extended into a medical instrument to supply light where needed. The disadvantages to this method are the excessive heat generated at the light source, the inefficient light capture since only a portion of the light ever makes its way into the fiber optic cable, and the limited mobility of the medical instrument, since it must always be at the end of a fiber optic cable. Sterilization requirements may also mitigate against the use of fiber optics at the working end of an instrument since repeated sterilization may cause a denigration of the fiber.

In portable instruments, several limitations are present. First, efficiency is of paramount importance. Since most of the instruments are battery powered, a large current drain would be unacceptable. An extended use would require an interruption in the procedure to change batteries, even if new batteries were supplied at the beginning of each new procedure.

Another important aspect is safety. In medical instruments, the bulb must be adequately supported and protected from breakage. Not only would breakage interrupt the procedure, but shards of glass could be introduced into contact with the patient. The bulb could be encased in an additional layer of translucent material, but such would cause a degradation of performance. This is especially true for white light having multiple frequencies which cannot be wavelength matched across a given thickness of material. Added covering materials would increase the heat load, diminish the light transmission, and would require more power for a given level of output. Greater power would, in turn, shorten the life of the incandescent bulb.

Recessing the bulb within a protective sheath for protection causes other problems. First, most of the light from the bulb which impinges on the walls of the sheath will otherwise be lost. Next, once the bulb is inserted within a protective sheath, it may be physically difficult to remove it from the sheath. Bulbs having protective metal envelopes, including bulbs with screw bases and which use the metal envelopes for reflectors are not able to gain sufficient structural stability from the metal envelopes. A sharp blow to the metal envelope could produce sufficient bending moment in the bulb to cause it to snap. Bringing the metal envelope closer to and in a supportive relationship with the bulb can defeat the reflector action of the metal envelope.

Another important issue is cost and reproducibility. For a given set of constraints, an incandescent light system could be custom designed. However, the driving force behind the lighting industry is mass production and cost. The incandescent system should be amenable to cost effective mass production such that the cost of a light source to be used with any instrument should be virtually insignificant compared to the cost of the overall instrument. As such, a system should have good integrity, meet the requirements of the sensitive environment, typically a medical environment, and be easily and cost effectively produced in large numbers.

What is therefore needed is a system for using high intensity bulbs, especially in environment sensitive applications such as medical applications. Such a system should be efficient, producing significant light output without significant loss of light not directed into the area of interest. Such a system should be light weight and very protective of the filament containing glass envelope but without significantly increasing the effort and speed with which a burned-out bulb may be replaced.

SUMMARY OF THE INVENTION

The incandescent bulb and reflector system of the present invention includes a small incandescent lamp which is incorporated into a reflector base. The reflector and base may be two separate components which fit together to form the reflector base. In certain embodiments, the glass envelope of the incandescent bulb is protected by a rim of the reflector portion which extends further in the direction of illumination than the maximum extent of the glass envelope. A square notch is provided in the rim of the reflector portion of the reflector base to facilitate turning movement about the axis of the rim to facilitate the changing of the incandescent bulb and reflector system.

The reflector portion of the reflector base has a first portion which closely engages the lower portion of the glass envelope and a second portion which is formed into a reflector structure to direct light from the filament into a forward direction. The base portion of the reflector base engages the reflector portion of the reflector base in several possible ways. The base portion protects the incandescent bulb's leads and arranges the conductors in a configuration consistent with that of a socket or female connector into which the completed lamp assembly will fit.

In one embodiment of the incandescent bulb and reflector system of the present invention the entire structure is only about 5.4 millimeters in diameter and 15.2 millimeters in length. The small size not only provides compactness and light weight, but the ratio of length to width militates against breakage, even when roughly handled.

The filament of a small incandescent lamp is contained within a hollow cylindrical envelope that is closed at its front, or light emitting end. A lens may be utilized at the front end to further project some of the light emitted by the filament and redirect it into a beam. The filament is ideally be spaced back a short distance from the lens. Light which propagates in a range of angles from perpendicular to the direction in which light is to be emitted to an acute angle in the direction in which light is to be emitted, is reflected and re-directed in the forward direction by a curved reflective surface on the inside of the base. The inside of the base which forms the reflector sweeps extends rapidly away from the glass envelope at a point which balances the capture of light with the support requirements for the glass envelope. The curvature of the reflector may be parabolic, elliptical or any shape which is necessary to re-direct the light and in any manner desired.

In one embodiment, the transition from the first portion of the reflector base which holds the glass envelope to the second portion of the reflector base which forms the re-directive surface may have a circular lip such that the second portion containing the re-directive surface has a smaller inner diameter than the first portion which secures the bulb. In another embodiment, a cylindrical portion of minimum internal diameter may form a third portion extending between the relatively larger diameter first portion and a same diameter second portion.

Ideally an adhesive is utilized to securely mount the glass envelope within the reflector base at a point close enough to the light emitting end of the glass envelope that minimum bending moment is exerted on the forward portion of the glass envelope. Adhesive is also typically employed to join the reflector portion to the base portion of the reflector base.

The manufacture of the lamp assembly of the present invention involves machining a length of bar stock to achieve both the bore and re-directive surface of the reflector portion. The base portion is machine bored and typically has an exterior surface which is flush with the reflector portion. In one embodiment, the base portion has a threaded portion which is spaced apart from the central portion of either the base portion or the reflector portion so that it may be fitted within a wider range of female electrical sockets.

BRIEF DESCRIPTION OF THE DRAWINGS

These and other aspects of the invention will be better understood from the following description in which reference is made to several drawings of which:

FIG. 1 is a side cross sectional view of an incandescent lamp;

FIG. 2 is a side cross sectional view showing a first embodiment of a one piece construction of a reflector base of the lamp system of the present invention;

FIG. 3 is a side cross sectional view showing the lamp of FIG. 1 mounted in the reflector base of FIG. 2 to form the lamp system of the present invention;

DETAILED DESCRIPTION OF THE PREFERRED EMBODIMENT

Figure 6:
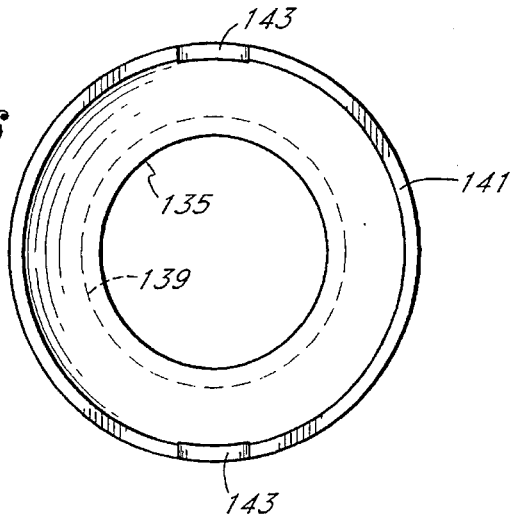
FIG. 6 is a top view of the reflector of FIG. 5.

FIG. 1 shows a small incandescent lamp 21 of a well known construction, typically used for flashlight bulbs. The lamp 21 includes a filament 23 that is attached at either of its ends to filament support legs 25 and 27. This assembly is then enclosed in an envelope 29 of glass or other light transmissive material. The envelope includes a hollow portion 31 closed at its front end by a lens 33 and closed at its rear end by the rear end portion 35 that the filament support legs 25 and 27 extend through.

FIG. 2 shows a cross section of a reflector base 37 in a first embodiment of the present invention. In this first embodiment, the reflector base 37 is a unitary structure having an imaginary central axis 39 extending therethrough. The internal surfaces of the reflector base 37 include a first reflector portion 41 which curves into an abrupt transition 43 and then into a central bore portion 45. The central bore portion 45 lies adjacent an angled transition portion 47. In machining the reflector base 37, the transition portion 47 may be milled simultaneously with the formation of the central bore portion 45. The other end of the angled transition portion 47 abuts a cylindrical rear bore 49.

The exterior of the reflector base 37 includes a cylindrical forward exterior portion 51, a threaded rear exterior portion 53 and a separation portion 55 which clearly separates the cylindrical forward exterior portion 51 from the threaded rear exterior portion 53.

FIG. 3 shows the lamp of FIG. 1 installed in the reflector base 37 of FIG. 2 to form a lamp assembly 55. Because it is known in advance that the lamp will be used in the base, the filament support legs 25 and 27 are not trimmed, but instead they are left long enough to extend to the rear portion of the reflector base 37 where the filament support leg 25 is connected to a center terminal 57, while filament support leg 27 is connected to the rear bore 49 of the reflector base 37. An insulator 59 fits into the cylindrical rear bore 49 and holds the center terminal 57 away from contact with the cylindrical rear bore 49, while at the same time pressing the filament support leg 27 against the rear bore 49. As can be seen at the right hand side of FIG. 3, when the filament 23 is in the position shown, some of the light that is emitted by the filament 23 in the lateral and rearward directions is intercepted by the reflector portion 41 and added to a collective beam 61.

In the configuration of FIG. 3, the rear end portion 35 and some of the sides of the lamp 21 are secured by the central bore portion 45. Note that the reflector portion 41 smoothly transitions into a rim 63 which extends forward to an extent sufficient to lie at or forward of the end of the lens 33 of the glass envelope 29 of the lamp 21. Although the view shown in FIG. 3 is a cross section, and although the filament 23 is shown as extending parallel to the section shown, it is understood that the reflection provided by the reflector portion 41 extends completely circularly and that reflection occurs about an annulus with respect to the lamp 21.

It is good practice, and will be shown that an insulator may be added to the leg 25 of the lamp 21 to insure that it will not inadvertently contact the inside surface of the reflector base 37, either when the lamp 21 is being mounted into the reflector base 37, or later when the lamp assembly 55 is subjected to forces through use.

Figure 4:
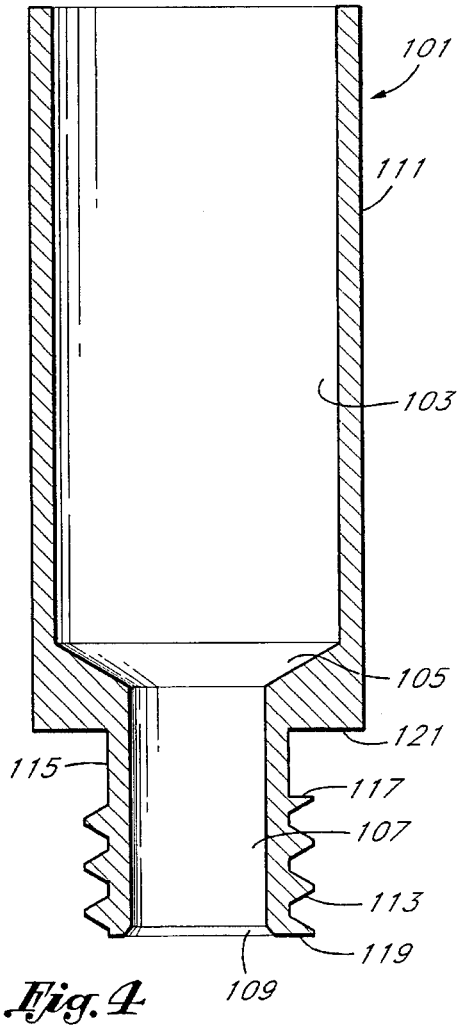
FIG. 4 is a cross sectional view of a separate base which is combinable with reflectors to be shown in subsequent FIGURES to form further embodiments of the lamp system of the present invention.

The reflector base of the lamp assembly of the present invention may be formed from two separate structures. Referring to FIG. 4, a separate base 101 which interfits with several reflector portions (yet to be shown) is illustrated. The dimensions will be disclosed to give an idea of the very small size of the base 101 as well as to show the manner of interfitting with the reflector portions.

The base 101 has a central bore 103 adjacent an angled transition 105. The other end of the angled transition 105 is adjacent a smaller rear internal portion 107. The smaller rear portion 107 abuts an angular chamfer 109 which is slight in length and is positioned at an angle of about 45°. The exterior of the base 101 includes a cylindrical forward exterior portion 111, a threaded rear exterior portion 113 and a separation portion 115 which clearly separates the cylindrical forward exterior portion 111 from the threaded rear exterior portion 113.

To give an idea of the ideal size of the base 101 and the way in which it will interfit with various reflectors, dimensions will be given. The internal diameter of the central bore is about 0.185 inches. The outer diameter of the cylindrical forward exterior portion of the base 101 is about 0.218 inches. The internal diameter of the smaller rear portion 107 is about 0.094 inches. The outer diameter of the separation portion 115 is about 0.122 inches, and it has an axial length of about 0.045 inches.

Note the flat area 117 which bounds the transition from the threaded rear exterior portion 113 to the separation portion 115, and the flat area 119 which bounds the threaded rear exterior portion 113 at its other end. This flat areas 117 and 119 will help to prevent cross threading which would be more prevalent with a threaded rear exterior portion 113 which would have had gradually arising threads. This is also important for positive engagement, especially where the completed lamp assembly is to be lowered into a cylindrically shaped socket and axially aligned due to the close fit of the interior portion of a socket with the exterior surface of a lamp assembly. The length of the threaded rear exterior portion 113 is about 0.090 inches. The existence of the separation portion 115 will enable less criticality between the upper edge of a socket containing interior threads of the socket (not shown) and the radially flat surface 121 which forms the transition between the cylindrical forward exterior portion 111 and the separation portion 115.

Figure 5:
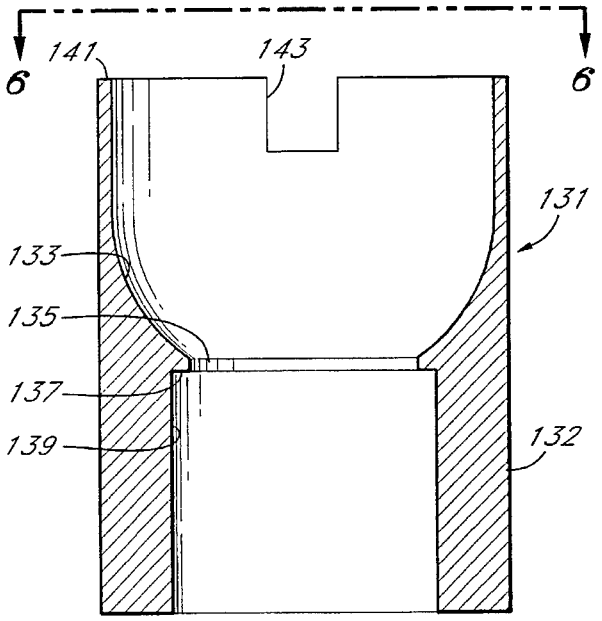
FIG. 5 is a cross sectional view of a separate reflector fittable over the base of FIG. 4 to form a second embodiment of the lamp system of the present invention.

Referring to FIG. 5, a cross sectional view of a first embodiment of a reflector 131 fittable over the base 101 is shown. Reflector 131 has an exterior surface 132 which has an axial length of about 0.440 inches. Reflector 131 has a reflector portion 133 which curves into an abrupt transition into a circular land 135 which represents the smallest diameter within the reflector 131. Adjacent the land 135 is a radial surface 137 which forms the transition to a base 101 accommodation bore 139. Accommodation bore 139 is ideally about 0.218 inches to match the outer diameter of the base 101. The radial surface 137 will limit the maximum extent to which the base 101 may be received within the accommodation bore 139, which is its axial length of about 0.200 inches.

The overall diameter of the reflector 131 is about 0.340 inches. The outermost portion of the reflector 131 forms a lip 141 having a nominal thickness of about 0.03 inches. As is shown in FIG. 5, one of a pair of square slots 143 is formed into the rim of the outermost portion of the reflector 131. The square slots 143 have a width and depth of about 0.06 inches, and oppose each other.

Referring to FIG. 6, an end view, taken along line 6—6 of FIG. 5 shows the relationship of the two square slots 143. The surface of the land 135 can be seen along with the lip 141. The transition from the square slots 143 to the reflector portion 133 can be clearly seen. As will be shown, the square slots 143 are used with a tool which can engage the reflector 131 along with its attached base to rotate the lamp system of the present invention into and out of an electrical socket.

Figure 7:
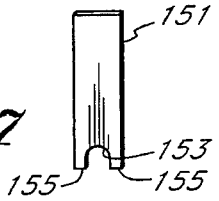
FIG. 7 is an installation tool utilizable with the lamp system shown formed by the reflector of FIG. 5 and the base of FIG. 4.

Referring to FIG. 7, an installation tool 151 is shown. The installation tool 151 is typically made of aluminum sheeting, about 0.050 inches thick. The installation tool 151 is about 0.338 inches wide and about an inch or so tall. A notch 153 exists at the center width of the end of the installation tool 151, and has a diameter of about 0.187 inches at its curving transition. The half circle curvature is offset from the end of the tool 151 a distance of about 0.060 inches, matching the depth of the square slots 143. Notch 153 defines a pair of legs 155. The legs 155 are intended to engage the square slots 143 which were shown in FIGS. 5 and 6. The notch 153 insures clearance with respect to lamp 21, which is necessary since the legs 155 extend below the lip 141 shown in FIGS. 5 and 6.

Figures 8, 9, 10:
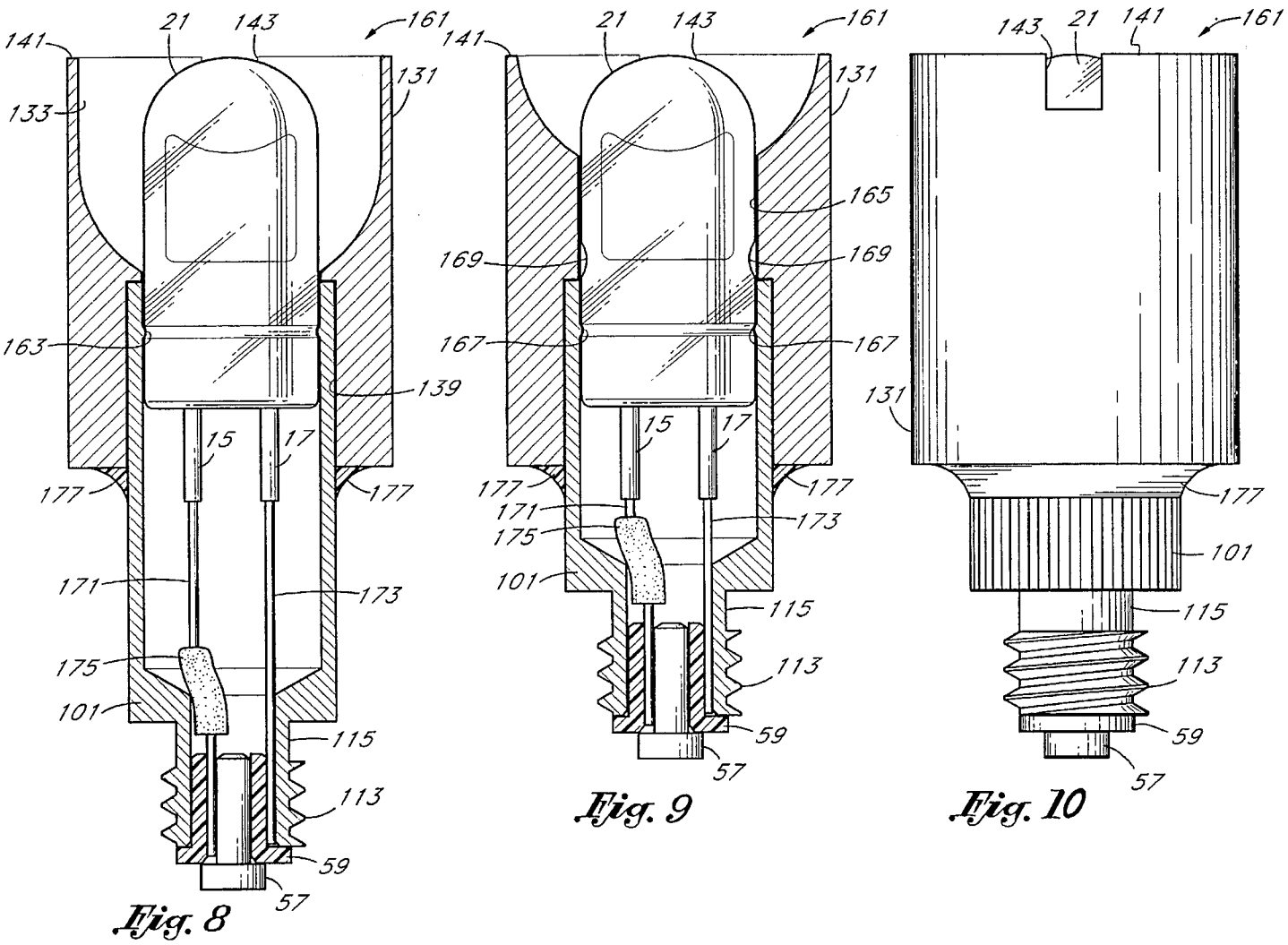
FIG. 8 is a cross sectional view of the separate reflector of FIG. 5 fitted over the base of FIG. 4 to form a second embodiment of the lamp system of the present invention.
FIG. 9 is a cross sectional view of a third embodiment of a lamp system similar to FIG. 8 but having an axially extended land portion.
FIG. 10 is a side view of the lamp system shown in FIG. 8.

FIG. 8 illustrates the base 101 of FIG. 4 assembled within the accommodation bore 139 of FIG. 5 to form a lamp assembly 161. In the manufacturing process, as was the case for reflector base 25, both the base 101 and reflector 131 may be made of aluminum, brass, steel, stainless steel, any metallic compound, plastic, glass, or other ceramic material. The reflector 131 is formed preferably with an automated milling machine, as is base 101. Once the reflector 131 is milled, the reflector portion 133 may be polished or metalized to form a highly reflective surface. The reflector portion 133 may be parabolic, elliptic or a specialized contour, depending upon the requirements. Preferably, the reflector portion 133 will be configured to work in concert with the lens 33 to refocus light from the filament 23 to a common area. In this configuration, the lamp 21 is first cemented within the base 101 using an adhesive. Next, the base 101 and lamp 21 assembly are inserted through the accommodation bore 139 of the reflector 131 and cemented in place, also preferably with an adhesive to form the lamp assembly 161. Note that the lamp 21 may have indentations 163 to accommodate the cementing of the lamp 21 to the internal portion of the base 101.

Referring to FIG. 9, an alternative embodiment is shown in which the reflector 131 contains an expanded length land portion 165 which provides additional support to the lamp 21. The lamp 21 may have indentations 167 to facilitate its being cemented to base 101, and may have indentations 169 to facilitate its being cemented to reflector 131. FIG. 9 also shows details of the internals of the lamp 21, including the use of a 0.01 inch welded nickel wire 171 and 173 to the leads 25 and 27, respectively. Also shown is an insulating tube 175 around the wire 171 which extends to the center terminal 43. Also note the permissible excess of adhesive 177 about the exterior of the base 101 at its interface with the reflector 131. The other structures of FIG. 9 are generally equivalent to the structures shown in FIGS. 4–8.

FIG. 10 is a plan view of the exterior of the lamp assembly 161 shown in FIGS. 8 and 9. Note the relationship of the base 101 and the reflector 131, and how the lamp 21 is recessed below the rim 141 of the reflector 131. The lamp 21 is, in this plan view taken from the side, only visible through the square slots 143.

Figure 11:
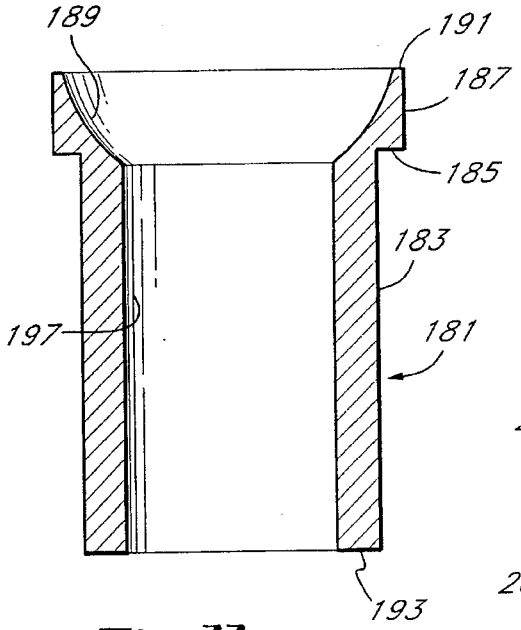
FIG. 11 is a cross sectional view of a separate reflector fittable within the base of FIG. 4 to form a fourth embodiment of the lamp system of the present invention.

Referring to FIG. 11, a second embodiment of a reflector 181 which may be utilized with the base 101 is shown. In this instance, the reflector 181 will fit inside the internal diameter of the central bore 103 of base 101. Reflector 181 has a central external portion 183 which ideally has an external diameter of about 0.185 inches, small enough to fit within the central bore 103 of the base 101.

At the upper end of the reflector 181, a radial surface 185 serves as a transition from the central external portion 183 to an outer portion 187 which has an outer diameter of 0.218 inches, generally matching the outer diameter of the base 101. The axial length of the outer portion 187 is about 0.050 inches. Note that a reflector surface 189 extends from a rim 191 at the upper surface of reflector 181 to a point below the radial surface 185.

The axial length of the reflector 181 is about 0.300 inches, so it will fit within the base 101 without having its lower rim 193 impinge upon the angled transition 105. This further means that radial surface 185 will engage the upper portion of the base 101 to limit the extent to which the reflector 181 will fit within the base 101. It is clear that in this configuration that the reflector 181 will provide the bulk of the support for the lamp 21. The internal diameter of the reflector is about 0.1287 inches in diameter which is seen to fit a different sized, smaller lamp 21 than was shown as supported by the 0.185 inch internal diameter of the base 101.

Reflector 181 has an internal surface 197 adjacent its reflector portion 189. Further, it is contemplated that the lamp 21 will, in the configuration of FIG. 11, extend beyond the rim 191 of the reflector 181. This is permissible for instances where the lamp assembly to be shown in FIG. 11 will be placed in a protective socket. Such extension may dictate a reflector portion 195 which is angled differently to take to account the forward location of the lens 33. Even though not shown in FIG. 11, the reflector 181 may be fitted with the square slots 143 which were shown in FIGS. 5 and 6.

Figure 12:
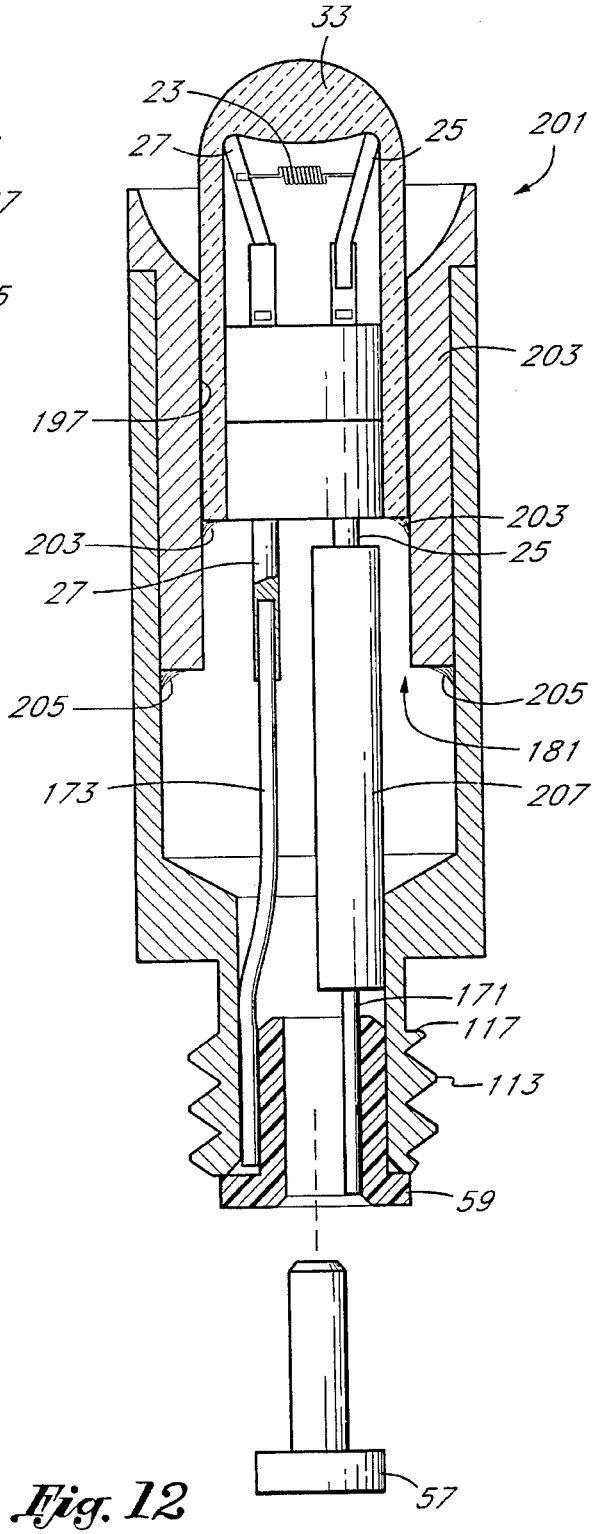
FIG. 12 is a cross sectional view of the separate reflector of FIG. 11 fitted within the base of FIG. 4 to form the fourth embodiment of the lamp system of the present invention.

Referring to FIG. 12, the reflector 181 of FIG. 11 is shown in place with respect to base 101 and with the lamp 21 to form a lamp assembly 201. The lamp 21 is shown cemented into the inner surface 197 of reflector 181, with some adhesive excess 203 shown at the lower interface of these structures. Similarly, some adhesive excess 205 is shown at the lower interface between the reflector 181 and the base 101. Also shown in FIG. 12 is an elongated length of teflon tubing 207 which not only covers a portion of the lead 25 and the wire 171 where the lead 25 and the wire 171 are attached together.

Note also that the base 101 is fitted with the insulator 59, but shows the center terminal 57 in a position removed from the insulator 59, since in some applications the center terminal 57 may be dispensed with. This is particularly true where the base into which the lamp assembly 201 contains a spike or other adequate projection at its center.

A great number of variations on the embodiment shown are possible and are likely to occur to workers in this field. These variations are considered to be comprehended by the present invention which is limited only by the following claims.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A reflector for use with a base comprising:

a reflector housing of generally hollow cylindrical shape having an internal surface extending from a front open end to a rear open end, and an external surface, the internal surface of said reflector housing defining:

a reflector surface adjacent said front open end;

a land adjacent said reflector surface and defining a constant radial surface through an abbreviated axial extent;

a radial transition portion adjacent said land; and an accommodation bore adjacent said radial transition portion of greater diameter than said land;

and wherein the external surface defines an exterior surface extending between said front open end and said rear open end.

2. A reflector base system including the reflector recited in claim 1 and further comprising:

a base housing of generally hollow cylindrical shape having an internal surface extending from a front open end to a rear open end, and an external surface, the internal surface of said base housing defining:

a central bore adjacent said front open end;

an angled transition portion adjacent said central bore; and a rear bore of smaller diameter than said central bore and adjacent said angled transition portion and near said rear open end;

and wherein the external surface of said base housing defines:

a cylindrical forward portion, adjacent said front open end, within which are located said central bore and said angled transition;

a separation portion, adjacent said cylindrical forward portion, within which is located said rear bore; and an externally threaded portion, adjacent said separation portion and said rear open end, said cylindrical forward portion fitted within said accommodation bore of said reflector housing to form a reflector base.

3. A lamp system including the reflector base recited in claim 2 and further comprising:

a lamp, fixed within said central bore of said base housing, and adjacent said constant radius surface of said land, having a pair of leads extending through said central bore, the light emitted by said lamp reflected by said reflector surface and away from said front open end of said reflector housing.

4. The reflector base system recited in claim 2 wherein said base housing defines a rim surface complementary to said radial transition portion.

5. The reflector base system recited in claim 2 wherein the constant radius surface of said land and said central bore have a common radius.

6. The reflector base system recited in claim 2 wherein said central bore of said base housing defines at least one indentation for accomodate cementing a lamp in place.

7. The reflector base system recited in claim 6 wherein said at least one indentation continuously extends about said central bore.

8. A lamp system recited in claim 3 wherein said lamp does not extend beyond said front open end.

9. The lamp system recited in claim 3 wherein said lamp is also fixed with respect to said land.

10. The lamp system recited in claim 3 wherein said base housing is electrically conductive and further comprising:

an insulator having an aperture, and fitted within said rear bore of said reflector base and bearing against one of said pair of leads and against the surface of said rear bore;

a conductive center terminal within said aperture of said insulator and bearing against the other of said pair of leads.

11. A reflector for use with a base comprising:

a reflector housing of generally hollow cylindrical shape having an internal surface extending from a front open end to a rear open end, and an external surface, the internal surface of said reflector housing defining:
a reflector surface adjacent said front open end; and
an internal bore adjacent said reflector surface;

and wherein the external surface defines:

an outer portion adjacent said front open end;

an exterior radial surface adjacent said outer portion; and a central external portion adjacent said radial surface and said rear open end.

12. A reflector base system including the reflector recited in claim 11 and further comprising:

a base housing of generally hollow cylindrical shape having an internal surface extending from a front open end to a rear open end, and an external surface, the internal surface of said base housing defining:

a central bore adjacent said front open end;

an angled transition portion adjacent said central bore; and a rear bore of smaller diameter than said central bore and adjacent said angled transition portion and near said rear open end;

and wherein the external surface of said base housing defines:

a cylindrical forward portion, adjacent said front open end, within which are located said central bore and said angled transition;

a separation portion, adjacent said cylindrical forward portion, within which is located said rear bore; and an externally threaded portion, adjacent said separation portion and said rear open end, said central external portion of said reflector housing fitted within said central bore of said base housing to form a reflector base.

13. A lamp system including the reflector base system recited in claim 12 and further comprising:

a lamp, fixed within said central bore of said reflector housing, having a pair of leads extending through said central bore, the light emitted by said lamp reflected by said reflector surface and away from said front open end of said reflector housing.

14. The reflector base system recited in claim 12 wherein said base housing defines a rim surface complementary to said exterior radial surface of said reflector housing.

15. The reflector base system recited in claim 14 wherein said outer portion of said reflector housing and said cylindrical forward portion of said base housing have a common radius.

* * * * *